United States Patent [19]

Janach et al.

[11] 4,264,107

[45] Apr. 28, 1981

[54] DEMOLITION TOOL FOR BREAKING SOLID MATERIALS

[75] Inventors: Walter Janach, Morges; Antoine Merminod, Treytorrens, both of Switzerland

[73] Assignee: Institut Cerac S.A., Ecublens, Switzerland

[21] Appl. No.: 77,580

[22] Filed: Sep. 21, 1979

[30] Foreign Application Priority Data

Oct. 10, 1978 [SE] Sweden ..... 7810557

[51] Int. Cl.[3] ..... E21C 37/24

[52] U.S. Cl. ..... 299/69; 91/313; 91/317; 91/276; 92/134; 173/119; 173/DIG. 4

[58] Field of Search ..... 299/37, 62, 69, 70; 173/116, 119, 120, DIG. 4, 15; 91/313, 317, 276, 308; 92/134

[56] References Cited

U.S. PATENT DOCUMENTS

| | | | |
|---|---|---|---|
| 3,049,097 | 8/1962 | Kershaw | 91/313 X |
| 3,739,863 | 6/1973 | Wohlwend | 91/317 X |
| 3,911,789 | 10/1975 | Bouyoucos | 92/134 X |
| 4,012,909 | 3/1977 | Hibbard | 92/134 X |
| 4,062,268 | 12/1977 | Hibbard | 92/134 X |
| 4,111,269 | 9/1978 | Ottestad | 173/DIG. 4 X |

*Primary Examiner*—Ernest R. Purser

*Attorney, Agent, or Firm*—Frishauf, Holtz, Goodman & Woodward

[57] ABSTRACT

A demolition tool for breaking solid materials, particularly rock or concrete in tunnelling, mining, demolishing and excavating applications. The tool has a single impactor (1) of the projectile type which is driven by high pressure liquid towards the material to be broken. A gas pressure accumulator (2) is included for storing high pressure energy. This energy is transferred at a high rate through short, wide and streamlined channel means (8, 13, 57, 9), having high capacity and low flow losses, to the impactor (1). Valve means (7) is provided in the channel means so that the accumulator (2) can be recharged during the return stroke of the impactor, giving a high repetition rate. A low pressure annular accumulator (5) drives the impactor during the return stroke.

9 Claims, 2 Drawing Figures

DEMOLITION TOOL FOR BREAKING SOLID MATERIALS

BACKGROUND OF THE INVENTION

The present invention relates to a demolition tool for breaking solid materials. It is particularly suitable for breaking rock or concrete in tunnelling, mining, demolishing and excavating applications.

A normal method of breaking rock comprises the steps of first drilling a number of holes with a percussive rock drilling machine and then loading the holes with explosives. The rock is then broken down by the forces created when the explosives are detonated. A percussive rock drilling machine cannot, in practice, be used for breaking down any considerable amounts of rock without the supplemental use of explosives, because of the limited energy delivered by each impact.

Another breaking method, which has so far been limited to demolition work, secondary breakage of rock and scaling, consists of using an impact hammer of the conventional jackhammer type which is larger, has a higher impact energy and is usually mounted on a backhoe or boom. In all impact hammers of this type, a reciprocating hammer is accelerated by compressed air or a pressurized liquid and strikes a chisel, which extends from the machine and is in contact with the material to be broken. The impact energy of such conventional impact hammers is limited by the maximum allowable impact velocity of the hammer, which is of the order of 10 m/s. An higher velocity would damage the contact surfaces of hammer and chisel too quickly.

One way of increasing the impact velocity, and thus the impact energy, consists in introducing a liquid cushion between the hammer and the working implement as described in U.S. Pat. No. 4,062,268. In this way the impact velocity can be increased to about 30 m/s. This means that the power to weight ratio is improved considerably since the impact energy is proportional to the square of the impact velocity.

Another prior art breaking device, which is suitable for demolition work, is described in U.S. Pat. No. 4,034,816. In this device the above mentioned velocity limitations are avoided because there is no impact between the hammer and a working implement. The hammer, or impactor, is of projectile type and is directly driven towards the material to be broken by combustion gas pressure.

SUMMARY OF THE INVENTION

The productivity of an impact hammer depends not only upon a high impact energy but also upon a high rate of repetition. The demolition tool according to the present invention comprises a single impactor of projectile type similar to the one shown in U.S. Pat. No. 4,034,816, allowing to achieve a higher impact velocity and therefore a much higher impact energy than with conventional hammer-chisel breakers. The tool further comprises a gas pressure accumulator, first liquid-filled channel means, piston means separating the gas and the liquid and valve means capable of establishing a liquid pressure driving connection between the piston means and the impactor through the first channel means. According to an advantageous embodiment of the invention the tool further comprises means for reciprocating the impactor to obtain a high rate of repetition. The combination of high impact energy with the high repetition rate results in a breaking productivity which is higher than with present impact hammers. This high productivity makes it possible to use the demolition tool to the present invention as an alternative to the conventional drilling and blasting method for the driving of tunnels and for underground mining applications.

BRIEF DESCRIPTION

Figure 1:
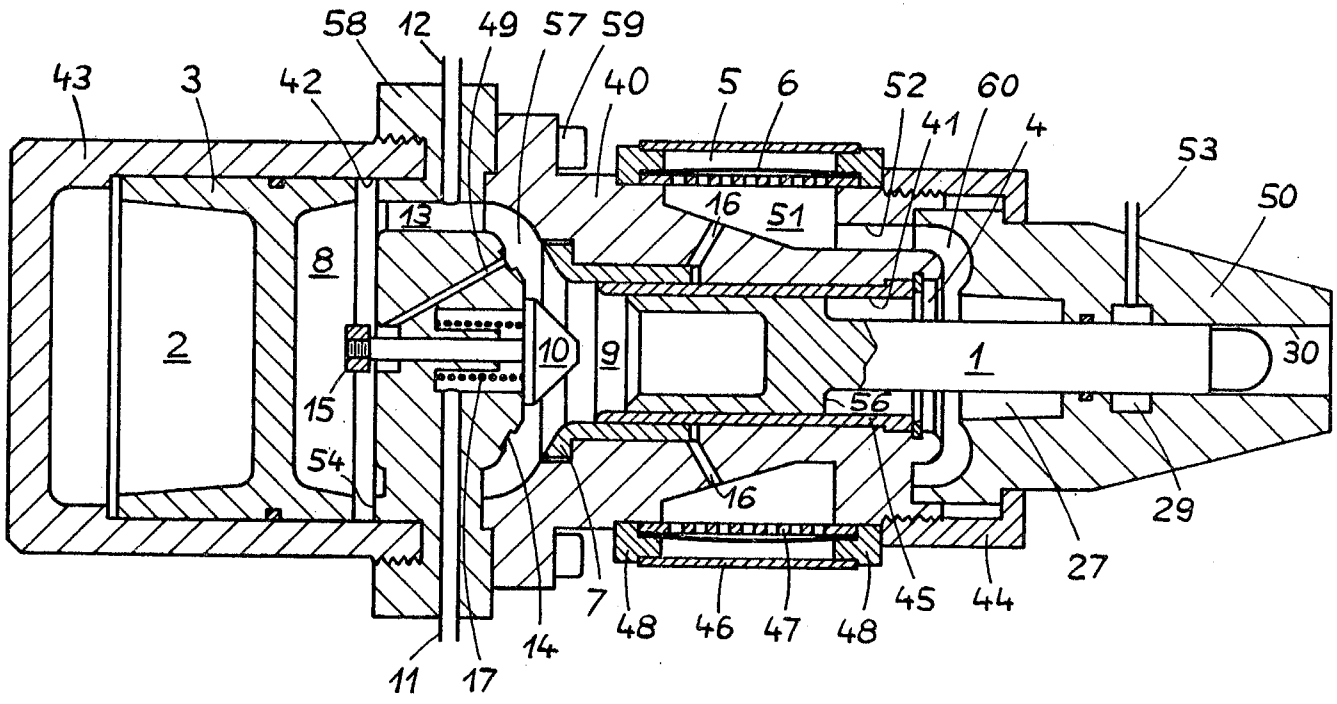
FIG. 1 shows a tool of the present invention during the power stroke.

The embodiment of the invention shown in the drawings only gives one example of the invention, which can be modified in several ways within the scope of the appended claims.

DETAILED DESCRIPTION

Figure 2:
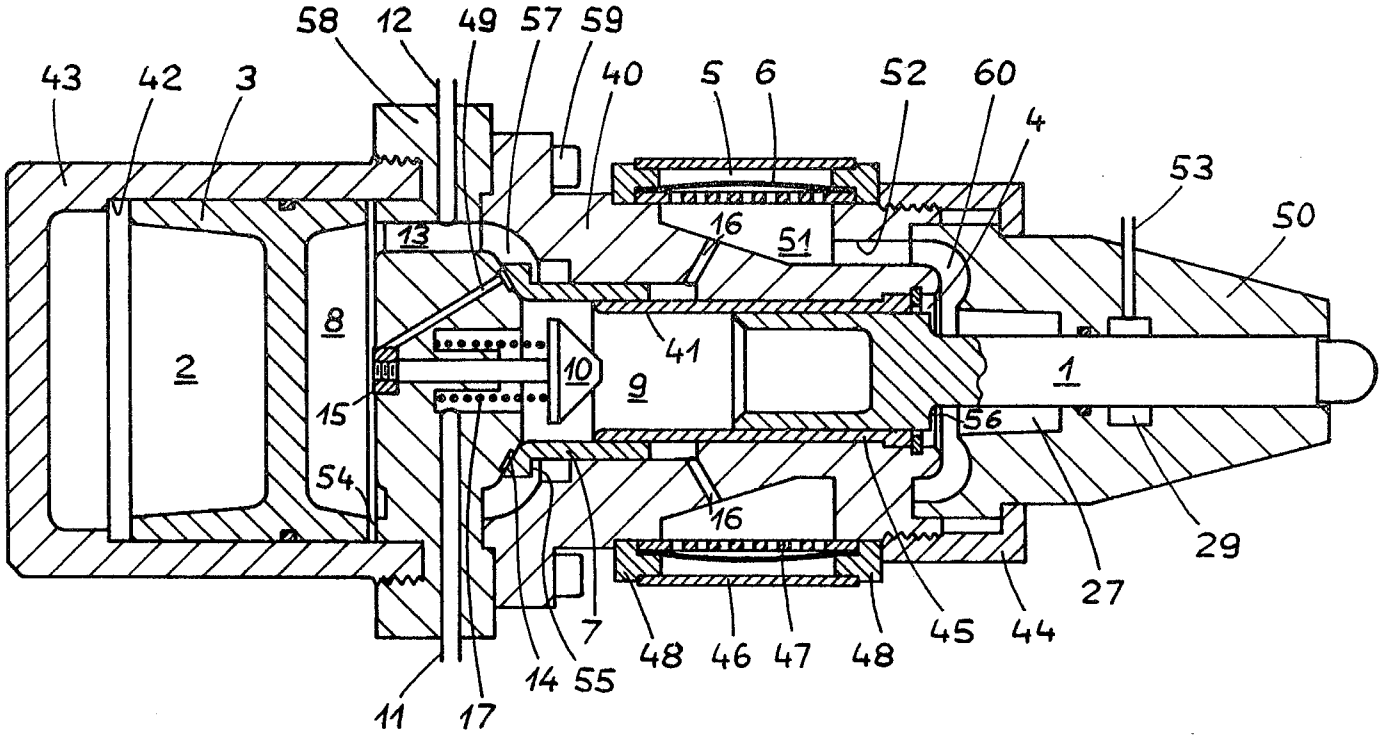
FIG. 2 shows the tool during the return stroke.

The tool shown in the drawings comprises a housing, which, in the shown example, consists of a base plate 58, an intermediate part 40, a front piece 50 and a cylinder 43. The intermediate part is fixed to the base plate by means of screws 59. The cylinder 43 is screwed into the base plate 58. The front piece 50 is clamped to the intermediate part 40 by a nut 44 which also fixes an annular gas accumulator 5 on the intermediate part. The intermediate part comprises a cylinder lining 45 which has a first bore 41 in which an impactor 1 is reciprocably movable. The impactor 1 extends into a bore 30 in the front piece 50. The intermediate part 40 is furthermore provided with valve means 7 being movable between an open position, FIG. 1, and a closed position, FIG. 2. The cylinder 43 is provided with a second bore 42 in which a light piston 3 is reciprocably movable. The piston 3 together with cylinder 43 define a gas pressure accumulator 2 in which the pressure during operation of the tool preferably is in the order of 200 bar. There is a not shown nipple for supply of compressed gas if needed. Liquid-filled first channel means, comprising chamber 8, a number of channels 13 through base plate 58, a streamlined and converging channel 57 and chamber 9, is provided between piston 3 and impactor 1. In order to avoid substantial pressure losses the channel means must be short, wide and streamlined. This means that the cross-sectional area should be as large as possible and that there should be no sharp bends in the flow path. The valve means 7 is capable of establishing a liquid pressure driving connection between the piston means 3 and the impactor 1. Because of the difference in diameter between the piston 3 and the impactor 1 the liquid-filled first channel means 8, 13, 57, 9 acts as a velocity booster. The impactor is in this way accelerated to a velocity of preferably 40–60 m/s before it impacts the material to be broken.

The maximum velocity of pitson 3 is in the preferred embodiment about 10% of the maximum velocity of impactor 1. This makes it possible to have a tight gas pressure seal between piston 3 and cylinder 43. The low velocity of piston 3 is necessary in order to avoid damage of the piston when it impacts the abutment area 54 at the end of the stroke. This limitation of the stroke is necessary in order to terminate the acceleration of impactor 1 just before it impacts the material to be broken. If the liquid pressure would continue to act on impactor 1 during impact, the whole tool assembly, including the supporting structure, would recoil in a violent way. Another reason for keeping the maximum velocity of piston 3 low is to keep its kinetic energy low because this energy is lost when piston 3 is stopped against the abutment area 54.

The annular low pressure gas accumulator 5 comprises a support sleeve 47 provided with a number of radial holes, two rings 48, an annular sleeve 46 and a cylindrical membrane 6 clamped between the support sleeve 47 and the rings 48. The membrane 6 separates the compressed gas in the accumulator 5 from the liquid in the first chamber 51, second channel means 52, 60 and second chamber 4. The channel 60 is annular and converges towards chamber 4. Channels 52, 60 should be short, wide and streamlined as is the case for channels 13, 57. Accumulator 5 is provided with a not shown nipple for supply of compressed gas if needed. During operation the pressure in accumulator 5 is preferably in the order of 10–15 bar. This pressure biases constantly, via membrane 6 and the liquid in first chamber 51, second channel means 52, 60 and second chamber 4, the impactor towards its retracted position inside the tool.

The base plate 58 is provided with a supply line 12 for high pressure liquid being in constant communication with channel 13. There is further a return line 11 whose communication with chamber 9 is controlled by return valve 10. Return valve 10 is biased towards open position by spring 17 and connected with trigger valve 15. Trigger valve 15 controls the communication between chamber 8 and channel 49 which is in communication with the annular recess 14. Valve 7 is biased towards its closed position by accumulator 5 via channels 16. The front piece 50 is provided with a conical retarding chamber 27 in which the impactor is stopped if there is no material in front of the tool. The front piece is furthermore provided with a channel 53 for supplying flushing fluid, water or air, to chamber 29 for flushing of bore 30 when impactor 1 is in its retracted position.

The tool shown in the drawings works in the following way. At the beginning of the power stroke impactor 1 is resting against return valve 10 which is closed. Trigger valve 15 has just opened. Valve 7 is held in its closed position by the pressure in channel 57 acting on the annular area 55, FIG. 2. Piston 3 is in its most leftward position and front piece 50 pressed against the material to be broken. When trigger valve 15 opens, high pressure liquid is supplied to recess 14 to move valve 7. When valve 7 has moved a little the whole rearward area is pressurized and valve 7 opens completely. A liquid pressure driving connection is thus established between piston 3 and impactor 1 through the first channel means 8, 13, 57, 9. Impactor 1 is now accelerated inside the tool in a forward direction towards the material to be broken. During the power stroke return valve 10 is held closed by the pressure in chamber 9. Shortly before the impactor 1 impacts the material to be broken, piston 3 is stopped by the abutment area 54. Because of the very low compressibility of liquid and because of the flow rate in supply line 12 is much lower than the maximum flow rate in first channel means 8, 13, 57, 9, the pressure in first channel means 8, 13, 57, 9 almost instantaneously drops to about atmospheric pressure while the impactor proceeds at substantially constant velocity because of its kinetic energy and impacts the material to be broken. Because of the action of annular accumulator 5, impactor 1 slows down a little before the impact. This means that the impactor starts to accelerate in a backward direction shortly before it impacts the material to be broken. The high pressure liquid is supplied at constant flow rate from a not shown pump. When the pressure in first channel means 8, 13, 57, 9 drops, return valve 10 is opened by spring 17. Trigger valve 15 is closed at the same time. Furthermore, valve 7 is closed by the annular accumulator 5 via channels 16. Then accumulator 2 is recharged by the action of high pressure liquid on piston 3, the liquid being supplied through supply line 12 by a suitable not shown pump. During this recharging process impactor 1 is returned to its initial position inside the tool by accumulator 5 which acts on the liquid in first chamber 51, second channel means 52, 60 and second chamber 4 and thus on area 56 on the impactor 1. The impactor 1 is thus biased in a backward direction by accumulator 5. During the return stroke liquid is pushed out through the return line 11. The different pressures and areas are so chosen relative to each other that recharging of accumulator 2 and returning of impactor 1 take about the same time. At the end of the return stroke impactor 1 contacts return valve 10 and closes it. At the same time trigger valve 15 is opened and the next cycle starts.

Since the accumulator 2 is recharged during the return stroke of impactor 1, a short cycle time and thus a high repetition rate is obtained.

We claim:

1. A demolition tool for breaking solid materials, said demolition tool comprising:
   - a housing (43, 58, 40, 50) provided with a first longitudinal bore (41) and a second bore (42);
   - a fluid pressure actuated impactor (1) reciprocably movable in said first bore (41) for impacting the solid material;
   - a piston means (3) reciprocably movable in said second bore (42);
   - a first gas pressure accumulator (2) defined by said piston means (3) and the housing;
   - first liquid-filled channel means (8, 13, 57, 9) which is short, wide and streamlined and which extends from said piston means (3) to said impactor (1);
   - valve means (7) for establishing a liquid pressure driving connection between said piston means (3) and said impactor (1) through said first channel means (8, 13, 57, 9) for a short period of time to accelerate the impactor in a forward direction;
   - biasing means including a second gas accumulator (5) biasing said impactor (1) in a backward direction, whereby the impactor starts to accelerate in said backward direction when the pressure in said first channel means (8, 13, 57, 9) falls below a predetermined value; and
   - means (54) for stopping said piston means (3) to terminate the acceleration of said impactor (1) before it impacts the material to be broken.

2. A tool according to claim 1, wherein said second gas accumulator (5) is annular.

3. A tool according to claim 2, wherein said second gas accumulator (5) is annularly formed around said housing.

4. A tool according to claim 1, wherein the ratio of the cross-sectional area of said piston means (3) is the maximum cross-sectional area of said impactor (1) is greater than 5.

5. A tool according to any one of claims 1, 2, 3 or 4, wherein said biasing means further comprises:
   - a liquid-filled first chamber (51) which is loaded by said second gas accumulator (5);
   - a second chamber (4); and
   - a second liquid-filled channel means (52, 60) which is short, wide and streamlined, said second liquid filled channel means connecting said liquid-filled first chamber (51) with said second chamber (4) to pressurize an area (56) on said impactor (1) for biasing said impactor in said backward direction.

6. A tool according to any one of claims 1, 2, 3 or 4, wherein said second gas accumulator (5) biases said valve means (7) towards its closed position, whereby said valve means (7) is closed when the pressure in said first liquid-filled channel means (8, 13, 57, 9) falls below a predetermined value so that said first gas pressure accumulator (2) can be recharged during returning of said impactor (1) by applying pressure to said piston means (3).

7. A tool according to claim 1, wherein said first accumulator (2) is a relatively high pressure accumulator and said second accumulator (5) is a relatively low pressure accumulator.

8. A tool according to claim 1 wherein said valve means (7) is situated between said piston means (3) and said impactor (1).

9. A tool according to claim 1 or 8, wherein said valve means (7) establishes said liquid pressure driving connection for said short period of time during the acceleration of said impactor (1).

* * * * *

UNITED STATES PATENT AND TRADEMARK OFFICE

CERTIFICATE OF CORRECTION

PATENT NO. : 4,264,107

DATED : April 28, 1981

INVENTOR(S) : JANACH et al

It is certified that error appears in the above—identified patent and that said Letters Patent is hereby corrected as shown below:

COLUMN 4, line 59, after "(3)", change "is" to --to--.

Signed and Sealed this

*Eighteenth* Day of *August 1981*

[SEAL]

*Attest:*

GERALD J. MOSSINGHOFF

*Attesting Officer*

*Commissioner of Patents and Trademarks*